United States Patent [19]

Day

[11] Patent Number: 4,953,458

[45] Date of Patent: Sep. 4, 1990

[54] MULTI-ACTUATOR HYDRAULIC PRESS

[76] Inventor: Charles L. Day, P.O. Box 1097, Days Mills Rd., Kennebunk, Me. 04043

[21] Appl. No.: 322,531

[22] Filed: Mar. 13, 1989

[51] Int. Cl.[5] ..... B30B 1/34

[52] U.S. Cl. ..... 100/269 R; 100/48; 100/214

[58] Field of Search ..... 100/214, 269 R, 258 A, 100/264, 269 B, 48

[56] References Cited

U.S. PATENT DOCUMENTS

| | | | |
|---|---|---|---|
| 3,000,295 | 9/1961 | Fenton | 100/214 |
| 3,115,089 | 12/1963 | Zandel | 100/214 |
| 3,400,625 | 9/1968 | Wrona | 100/214 X |
| 3,757,680 | 7/1973 | Williams | 100/214 X |
| 3,920,364 | 11/1975 | Cadogan-Rawlinson et al. | 100/214 X |
| 4,295,358 | 10/1981 | Bulmer | 100/214 X |
| 4,502,379 | 3/1985 | Sato | 100/214 |
| 4,690,049 | 9/1987 | Malashenko | 100/269 R X |
| 4,694,744 | 9/1987 | Hepburn et al. | 100/259 R X |
| 4,729,302 | 3/1988 | Manning | 100/269 R X |

FOREIGN PATENT DOCUMENTS

| | | | |
|---|---|---|---|
| 2642357 | 3/1978 | Fed. Rep. of Germany | 100/269 R |
| 1242403 | 7/1986 | U.S.S.R. | 100/269 R |
| 1323409 | 7/1987 | U.S.S.R. | 100/269 R |
| 1329993 | 8/1987 | U.S.S.R. | 100/269 R |

*Primary Examiner*—Harvey C. Hornsby
*Assistant Examiner*—Stephen F. Gerrity
*Attorney, Agent, or Firm*—Davis, Bujold & Streck

[57] ABSTRACT

A hydraulic press; having two platens, a multiplicity of hydraulic cylinders, capable of actuation in series, parallel, or passively to generate a plurality of velocities and pressures, on demand, either up acting or down acting, and with all opposing velocities and forces equal, yet requiring less energy for operation than the prior art.

18 Claims, 6 Drawing Sheets

MULTI-ACTUATOR HYDRAULIC PRESS

The present invention relates to a multi-actuator, multi-speed, multi-pressure hydraulic press operable as an up acting, or down-acting press as desired.

BACKGROUND OF THE INVENTION

Inherent in conventional hydraulic press design is a lower platen or bed rigidly connected to a stationary upper platen by posts or tie rods. An acting or movable platen that is guided by these tie rods is moved upward or downward forcibly by a hydraulic cylinder mounted centrally above the upper stationary platen or below the lower stationary platen with the piston rod connected to the acting or movable platen.

In this traditional press structure hydraulic pressure generated by an associated hydraulic power and control unit acts on the large area side of the piston, i.e. the side having no piston rod in order to move the piston, rod, and platen generally away from the cylinder body. The frame, massive steel plates, tie rods, opposing stationary platen, etc. are necessary to support the entire force developed by the hydraulic pressure acting on the piston. This frame accounts for a great deal of the total weight, bulk and expense associated with the traditional hydraulic press.

Also as the piston forces the movable platen against the opposing stationary platen, there is a large bending moment created in the stationary platen due to the distance from the center of the hydraulic force to the extreme edges of the stationary platen, resulting in the need for the stationary platens to be of a greater thickness. That is to say, the maximum bending moment for the single hydraulic cylinder is the product of the maximum hydraulic force acting at the center of the greatest span of the opposing platen.

Furthermore, with the use of a single hydraulic ram it is not possible to put robotic mechanisms, vacuum supplies, or knock-out rods in or near the center of the stationary (force) platen.

Also, it is standard practice in the design of the hydraulic press to require high approach speed in order to minimize cycle time. Then, when the mold halves are in close proximity, a multitude of possible requirements exist if one considers the complexity of possibilities of general purpose molding.

The basic solution of these on-going problems lies in providing repeatable precise control of tonnage, velocity, and rate of change thereof. However with a conventional press this precise control can only be approached after a major addition of auxiliary components and expense, or in many cases, simply not at all.

In addition, the cracking (early opening) force utilized in the prior art, is always less than the closing force, and inherently reduces opening velocity. Intrinsically, any increase in either opening force or speed correspondingly decreases the other proportionally. That is to say, a gain in both tonnage and velocity at the same time is not possible, and once implemented, the decision is irrevocable.

Multiple actuator presses have also been proposed and attention is drawn to U.S. Pat. Nos. 3,920,364, 4,295,358, 3,000,295, 3,757,680, 4,502,379 and 3,115,089, all of which relate to prior art presses utilizing a plurality of hydraulic actuators. Of these, the following deserve specific comment.

U.S. Pat. Nos. 3,757,680 and 3,920,364 disclose a press in which the platens are joined by a plurality of actuators in a symmetrical arrangement in which there are no reaction pressures against the press itself. The actuators themselves provide guidance for the platens. This arrangement utilizes actuators providing a different tonnage on molding than on the reverse break direction.

U.S. Pat. No. 4,295,358 discloses a press with more or less conventional guides in which a plurality of hydraulic actuators are utilized.

U.S. Pat. No. 3,000,295 discloses a press using a plurality of double acting hydraulic cylinders for its operation. This arrangement is not believed particularly pertinent.

U.S. Pat. No. 3,115,089 relates to a tandem press mounted coaxially so that the pressure induced into either or both of the cylinders will induce downward movement of the platen 14. The arrangement is that one or both cylinders may be operated to provide different operating pressures and it is specified that if the cylinders have different capacities three different pressure ranges are possible without pressure regulating equipment. This patent suggests using one or both of a pair of actuators operating in parallel.

In general, it is the object of this invention to overcome the foregoing and other difficulties of the prior art designs by the provision of a novel new unireaction hydraulic press, particularly to its inherent controllability, versatility, generally simple construction and lower cost, both in cost of materials and in energy to operate.

Another object of this invention is to provide for instantaneous interchange of movement (i.e., from up acting to down acting and visa versa).

SUMMARY OF THE INVENTION

According to the invention, there is provided a hydraulic press comprising:

a pair of platens defining a work area therebetween;

a plurality of pairs of like double-acting hydraulic actuators, each actuator interconnecting the platens to provide an actuating force to change the spacing between the platens, each said pair of actuators being disposed symmetrically about said work area whereby upon their actuation in unison, they create a force acting along an axis passing through said work area with all said pairs of actuators, when acting in unison, producing an actuating force along the same said axis, and a control means for controlling a supply of a hydraulic fluid under pressure to the actuators so that, in a first operating mode, a said first pair of said actuators function in series to provide a relatively high rate of change of said spacing, in a second mode, at least said first pair of actuators function in parallel to provide for a rate of change of said spacing which is less than in the first mode and, in a third mode, at least said first pair of actuators function in accordance with said second mode while simultaneously a second pair of said actuators functions in parallel with said first pair of actuators thereby to provide a maximum actuating force for that fluid supply a relatively low rate of change of said spacing.

The maximum bending moment for the present invention is the product of one-quarter of the tonnage acting at the center of the shortest span.

BRIEF DESCRIPTION OF THE DRAWINGS

The invention will now be described, by way of example, with reference to the accompanying drawing, in which.

DESCRIPTION OF THE PREFERRED EMBODIMENT

Figure 1:
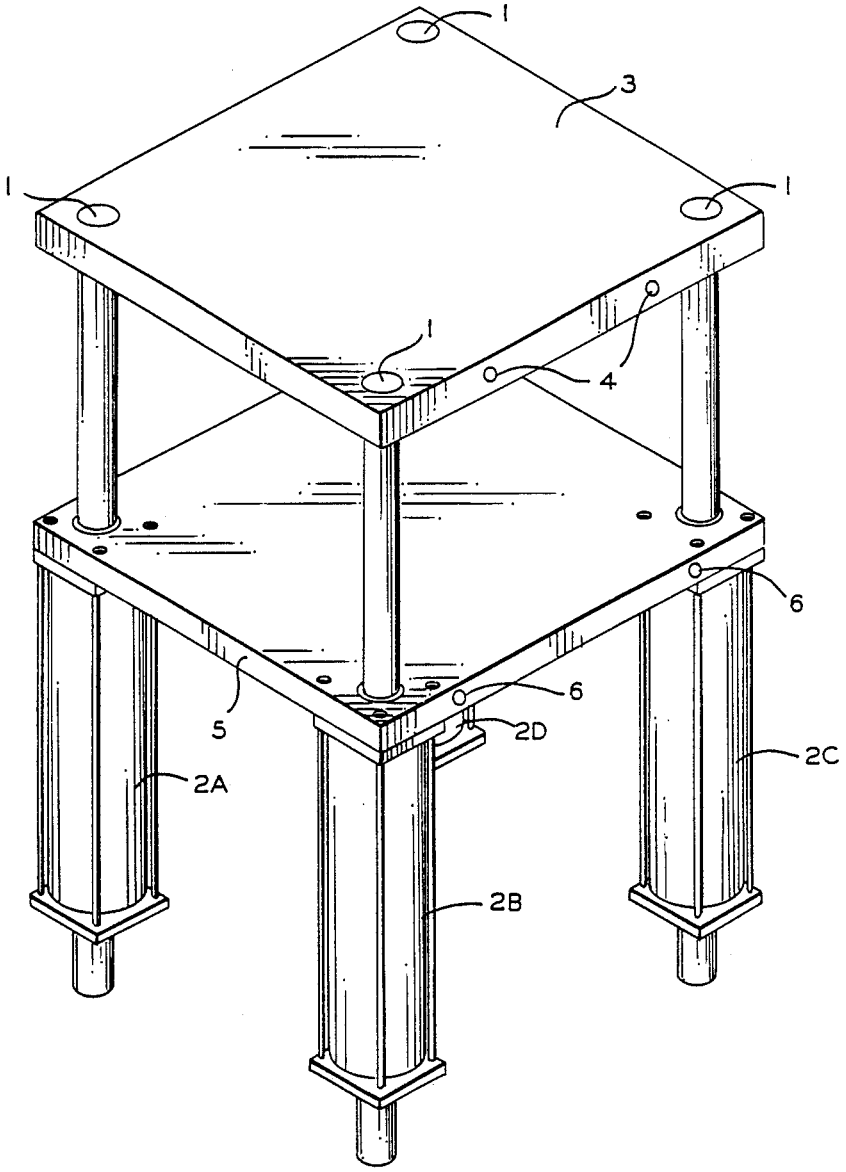
FIG. 1 is an isometric view of a basic arrangement of the present invention.

With reference first to FIG. 1, the upper cylinder rod ends (1) of four identical double-acting hydraulic actuators (2A, 2B, 2C and 2D) are rigidly attached to an upper platen (3). At the outer sides of the platen (3) is located a means of attachment, preferably but not necessarily, precision holes (4), suitably placed. The upper cylinder bodies of the four identical double-acting hydraulic actuators (2) are rigidly attached to the lower platen (5). At the outer sides of the platen (5) is located a means of attachment, preferably but not necessarily, precision holes (6) suitably placed.

Figure 2:
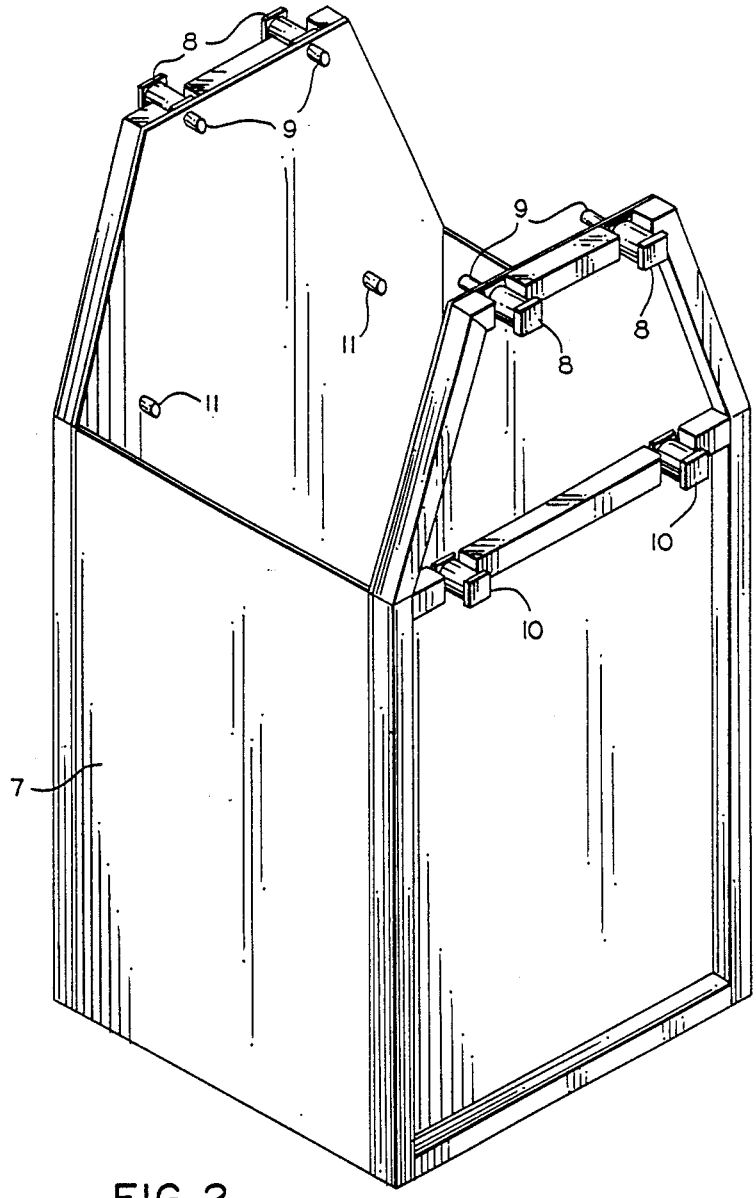
FIG. 2 is an isometric view of a preferred press support, hydraulics reservoir and, hydraulics housing of the present invention.

Referring to FIG. 2, hydraulic reservoir tank, press assembly support, and primary hydraulics (pump-manifold-valves) are preferably housed in the reservoir-support-housing (7). The reservoir-support-housing (7) is of liquid tight sheet steel construction. The structure is rigidized by the addition of a structural steel frame. At precise locations, predetermined by the position of the upper platen (3) means of attachment (4), is the mating component of that means, preferably double-acting hydraulic actuators (8). These actuators are rigidly attached to the upper portion of the reservoir-support-housing (7), such that when extended their rods (9) will easily and closely fit the holes (4) in the outer sides of the upper platen (3), thus rigidly connecting the upper platen to upper position of the reservoir-support-housing when desired, but not permanently. At lower precise locations predetermined by the position of the lower platen attachment means (6), are the mating component of those means, preferably, double-acting hydraulic actuators (10). These actuators are rigidly attached to the press lower stroke limit position of the reservoir-support-housing, such that when extended their rods (11) will easily and closely fit the holes (6) in the outer sides of the lower platen (5), thus rigidly connecting the lower movable platen to the lower stroke limit position of the reservoir-support-housing when desired, but not permanently. Operation of actuators (8) and (10) will be described with reference to FIG. 8.

Figure 3:
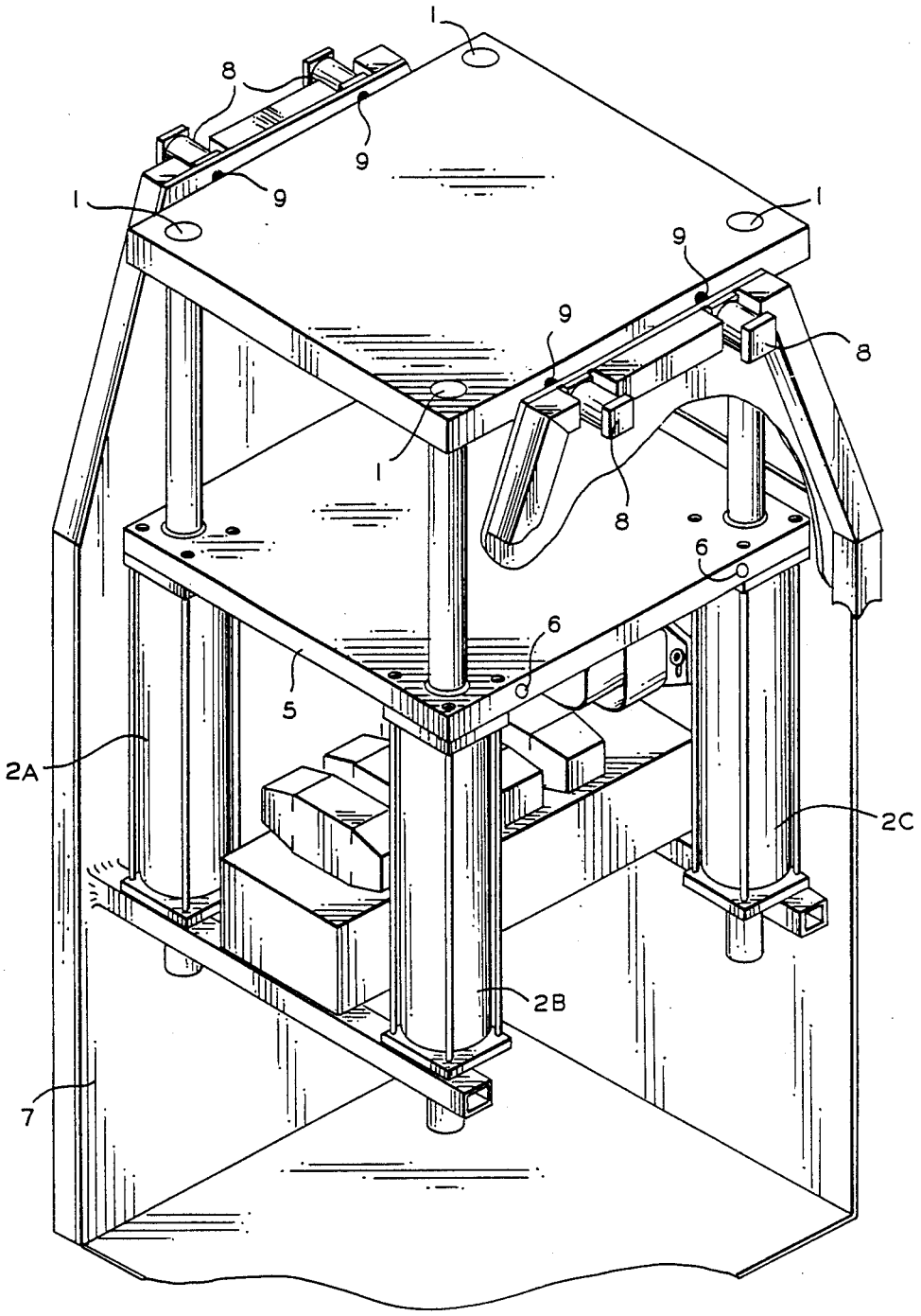
FIG. 3 is a cut away isometric view of the preferred press assembly.

The preferred physical layout is depicted in FIG. 3. However, the press support might be separate from the hydraulics, the support hydraulics (pump, valves, manifold and reservoir) might be remote to the press, etc. in other designs within the scope of this invention. With reference to FIG. 3, the basic press of FIG. 1 is placed into the reservoir-support-housing (7) of FIG. 2. Below the basic press is located the hydraulics; pump, manifold, valves, and connecting hoses (hoses and ancillary components, are omitted in this figure to preserve clarity but, are obvious to those knowledgeable in the art). Below the hydraulics is stored an adequate volume of hydraulic fluid to serve the hydraulic functions required.

Figure 4:
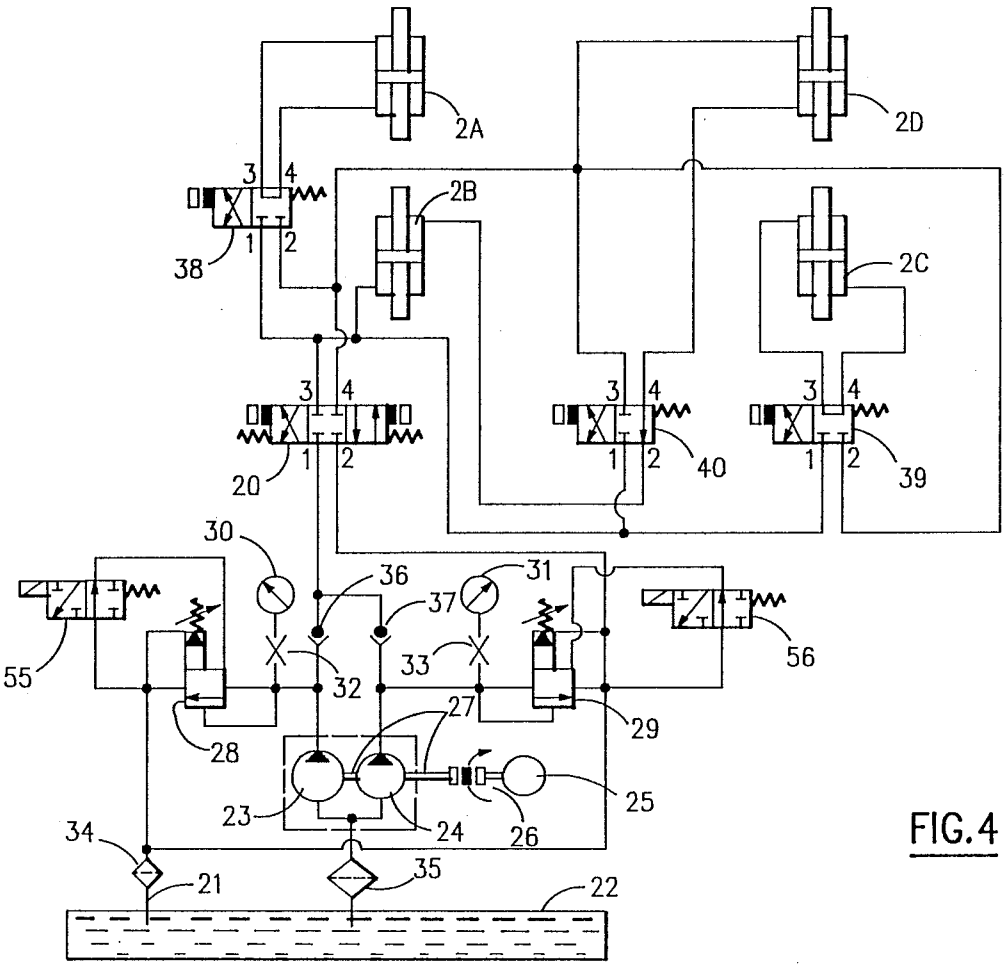
FIG. 4 is a schematic diagram of the basic hydraulic circuit.

A basic preferred form of hydraulic system is illustrated schematically in FIG. 4 of the drawings. Pressure hydraulic fluid is supplied to the main control valve (20) as well as a return (21) to the hydraulic reservoir (22). The hydraulic fluid under pressure is supplied by two pumps (23) and (24) both driven by motor (25) by way of coupling (26) and a common shaft (27) and both taking their fluid supply from reservoir (22). Pump (23) has a supply capacity of 33⅞ gal./min. at a pressure of 230 lb./square in. and pump (24) has a capacity of 4⅛ gals./min. at a pressure of 2,000 lb./square in. The pumps (23) and (24) are connected to return (21) by way of solenoid operated shut-off valves (55) and (56) pressure relief valves (28) and (29) respectively each valve (28) and (29) coupled with a pressure gauge (30) and (31), by way of a flow restricting orifice (32) and (33), connected to indicate the supply pressure of the associated pump (23) and (24).

Fluid passing from the return (21) to the reservoir (22) and from the reservoir (22) to the pumps (23) and (24) passes through filters (34) and (35), respectively.

The separate outputs on pumps (23) and (24) pass through non-return (check) valves (36) and (37) respectively to a first port of a solenoid operated three position (cross-flow, closed and parallel flow) spool valve which forms the main control valve (20). A second port of the main control valve (20) is connected to return (21). A third port of valve (20), connected to the first port when this valve is in the parallel flow position, is connected to supply fluid to a first port of like solenoid operated two position (cross-flow, by-pass flow) supply valves (38) and (39). A second port of each valve (38) and (39) is connected to a fourth port of valve (20) which in the parallel flow position of valve (20) is connected by way of the second port of valve (20) to the return (21). Third and fourth ports of valve (38) and (39), which in the crossed flow position of these valves, are connected to the first ports and second ports respectively of valves (38) and (39), are connected to opposite ends of the cylinders of a pair (2A) and (2C) of double-acting, hydraulic actuators (2). The third and fourth ports are joined together in the by-pass position of valves (38) and (39).

All four of the hydraulic cylinders 2A, B, C and D are identical double-acting hydraulic actuators each having and equal operating area on both sides of the piston thereof whereby they can provide identical actuating forces in both operating directions. In the hydraulic circuit is shown in FIG. 4, hydraulic actuators 2A and 2C are auxiliary actuators used when maximum tonnage is required while cylinders 2B and 2D can be connected in series or in parallel when lower pressures and higher operating speeds are required. Under conditions in which maximum tonnage is required, all four actuators 2A, 2B, 2C and 2D are used in parallel.

It will be appreciated that the third and fourth ports of the main valve (20) are reversed in function when this valve is in the cross-flow position. The third port of valve (20) is connected to one end of the cylinder of hydraulic actuator (2B) and to a first port of a solenoid operated two-position (cross-flow and a position in which a first and third port of this valve are closed and a second and fourth port are connected) spool valve (40). The end of the cylinder of actuator (2B) remote and on the far side of the piston thereof from its connection to the third port of valve (20) is connected to the second port of valve (40) and, in the position of that valve (40) shown in FIG. 4, by way of the fourth port of valve (40) to one end of the cylinder of actuator (2D) whereby in the valve positions shown in FIG. 4 actuators (2B) and (2D) will be operated in the same direction when fluid is supplied through the control valve (20). The other end of the cylinder of actuator (2D) is connected to the third port of valve (40) and to the fourth port of valve (20) for onward connection in the parallel position of that valve to the drain (21). With the valve position shown in FIG. 4 for valve (40), the actuators (2B) and (2D) will operate in series with exhaust fluid from actuator (2B) entering the inlet of actuator (2D) and with the exhaust of actuator (2D) passing to exhaust by way of valve (20) when that valve (20) is in its parallel flow position. When valve (40) in its cross-flow position, actuators (2B) and (2D) are connected in parallel with both of their exhausts passing to return (21) when valve (20) is in its parallel flow position.

When valve (20) is actuated by one of its solenoids to move it to its cross-flow position, hydraulic fluid flows to the top port of actuator (2D). When the upper platen (3) is attached to the upper portion of the reservoir-support-housing (7) by means of the actuator rods (9), with the result that the piston and rod of actuator (2D) are held stationary relative to that housing, the cylinder body of actuator (2D) is forced to move upwards, forcing the connected lower platen (5) to move upward toward the attached upper platen (3). The exhaust fluid from actuator (2D) is forced in this condition from the lower port of actuator (2D) through the parallel flow position of valve (40) to the top port of actuator (2B) forcing the cylinder body of actuator (2B) also to move upwards with the connected lower platen towards the attached upper platen. Exhaust fluid is forced, in this condition, from the lower cylinder port of actuator (2B) to flow through valve (20), by way of return (21) to the reservoir (22). In this condition, actuators (2B) and (2D) operate in series in opposite manner, due to the cross-flow position of valve (20), to that previously described for such series operation.

In the aforedescribed series operation of actuators (2B) and (2D), actuators (2A) and (2C) passive with their upper and lower ports connected together by the bypass connection position of valves (38) and (39). Accordingly, in this position, only one quarter of the fluid needed to move all four actuators in parallel is required to move the platen and to move all four actuators with the platen. As a result during the opening and closing of the press when the hydraulic actuators are being used only to move the press parts themselves, as opposed to when an actual pressing operation is taking place, a significant saving in energy is achieved compared with the single actuator prior art press where the entire hydraulic system must be operated with full fluid flow required to open and close the press at the same velocity for a press of the same tonnage as that of the present invention.

The position illustrated for valve (40) is the rest position for this valve. Upon energization of the solenoid of valve (40), the valve is moved to its cross-flow position and exhaust fluid from the lower port of actuator (2D) is diverted by way of valve (20) when in its cross-flow position to return (21) and the reservoir (22). At the same time, fluid is supplied to the top port of actuator (2D) in parallel to the supply to the top port of actuator (2B) so that these actuators (2B) and (2D) operated in parallel at half of the velocity and twice the potential tonnage of their series operation. Here both actuators (2B) and (2D) exhaust fluid from their lower ports to reservoir (22).

To achieve the full design tonnage of the press, actuators (2A, 2B, 2C and 2D) are required to operate in parallel. When this is required, actuator (2B) and (2D) are set to operate in parallel as described above and valves (38) and (39) actuated by solenoids to assume their cross-flow position which, as a result of the cross-flow position in which valve (20) is already set causes fluid under pressure to be supplied to the upper ports of actuators (2A) and (2C) to cause the cylinder bodies of these actuators to urge platen (5) upwardly toward platen in a similar in balance manner to the urging of platen (5) towards platen (3) by actuators (2B) and (2D). As a result, platen (5) is urged upwardly by four equal forces symmetrically disposed about the platen and capable of providing the design tonnage of the press. It will be appreciated that when four actuators (2A, 2B, 2C and 2D) are operating in parallel with the same volume of fluid supply as is available when only actuators (2B) and (2D) are being actuating in parallel, the velocity of the platen will be halved, that is, one quarter of the velocity available when actuators (2B) and (2D) are operating in series. At the same time, the available tonnage is quadrupled.

To open the press from the closed position, following the described actuator action of the system with valve (20) in its cross-flow position, the valves (38) and (39) are returned to their bypass positions, valve (40) is returned to its non-cross flow position and valve (20) is moved by its solenoid actuators to its parallel flow position whereby actuators (2B) and (2D) will be caused to function in series in a direction to their original operating direction thereby to move platens (3) and (5) apart.

In a situation where the lower platen (5) is attached to the housing (7) by cylinder rods (6) and the upper platen (3) is free to move the reverse operation of the press described above is possible by simply starting operation when the platens are apart and moving valve (20) is its parallel operating position and proceeding otherwise as before. In this case, the opening of the press is achieved by moving the valve (20) to its cross-flow position. An interlock, preferably in the form of an electrical control circuit (not shown), is desirable in order to avoid the actuation of valves (38) and (39), to the cross-flow position, unless valve (40) is in its cross-flow position. It will be appreciated that velocities and potential tonnage are the same in both operating directions of the press as a result of the equal piston area on either side of the double acting pistons of actuators (2A, 2B, 2C and 2D).

With the use of a traditional two pressure, two volume "high-low" hydraulic system as the prime driver as shown in FIG. 4, a multitude of repeatable velocities and tonnages are afforded without use of proportional pressure control valves or regeneration valves.

Figure 7:
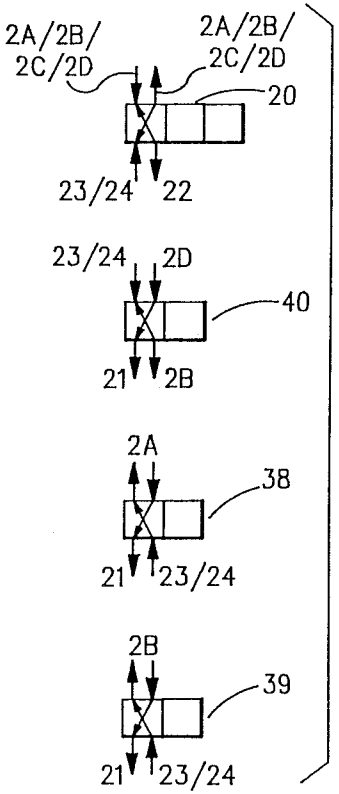
FIGS. 5, 6 and 7 are flow diagrams of three operating conditions of the circuit of FIG. 4.
Figure 6:
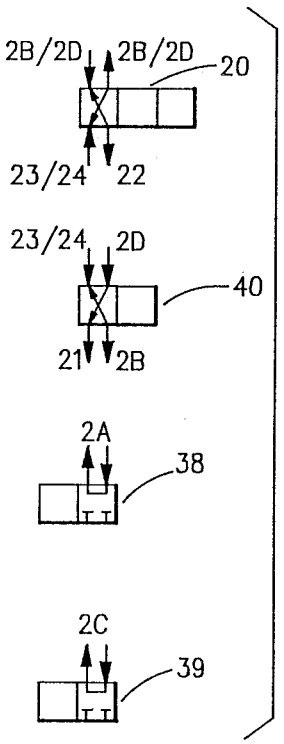
Figure 5:
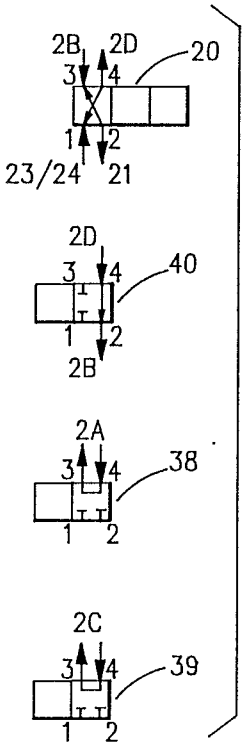

Now referring to FIGS. 5, 6 and 7, flow charts are shown for the situations described with respect to FIG. 4 in which the upper platen (3) is fixed, the lower platen (5) is movable and the actuators 2A, 2B, 2C and 2D) are operable to close the platens together, that is to move platen (5) upwardly towards platen (3). FIG. 5 shows the high speed, one quarter potential tonnage operation in which actuators 2B and 2D) are operated in series. FIG. 6 shows the midspeed, one half potential tonnage condition in which actuators (2B) and (2D) are operated in parallel. In both FIGS. 5 and 6, actuators (2A) and (2C) are passive. FIG. 7 shows the full potential tonnage operation. The speeds and tonnages are relative to one another and are based on the assumption that FIGS. 5, 6 and 7 for the same operating state of the pumps (23/24), i.e., that either both of these pumps are operating, pump (23) is operating alone or that pump (24) is operating alone. The reference numbers used in FIGS. 5, 6 and 7 are consistent with those used in FIG. 4 and illustrate in the case of the port connections of the various valves the ultimate destination of the fluid flow in terms of the actuators, supply pumps and reservoir. It should be noted that while pumps (23) and (24) are listed as (23/24) the same individual pump or the pair of pumps is considered to be operating in all examples to provide consistency between the speed and tonnage indications By comparison with a conventional prior art press having a single hydraulic actuator and two pumps capable of individual simultaneous supply of hydraulic fluid (which provide three speed operation, a single acting press, opening or crack tonnage which is smaller than the closing tonnage and requires a three platen construction). The present invention as heretofore described is capable of nine opening and closing speeds with associated nine potential tonnages and equal opening and closing tonnages as well as a double acting operation and two platen construction.

Figure 8:
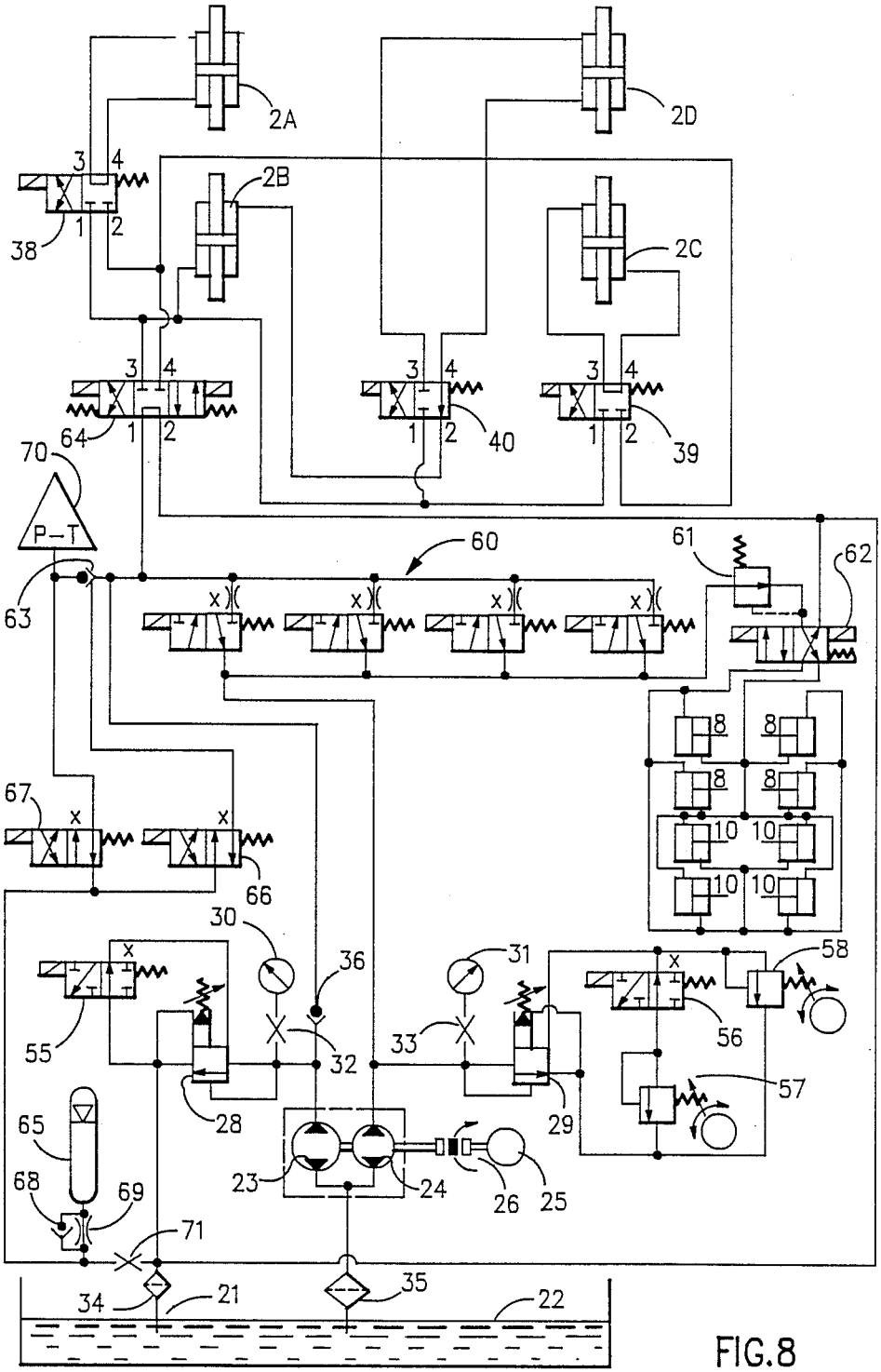
FIG. 8 is a schematic diagram of a more detailed preferred hydraulic circuit.

The hydraulic schematic of FIG. 8 includes the addition of primary hydraulic pressure, flow, safety, acting direction and general control arrangements that are preferably used in support of the schematic shown for the operation of the press in FIG. 4.

In FIG. 8, hydraulic fluid is drawn from the hydraulic reservoir (22), through a fine mesh filter (35) by hydraulic pumps (23,24) as in FIG. 4.

The flows from pumps (23,24) may be vented to the reservoir (22) through return (21) by way of pressure relief valves (28) (29) respectively in the case of an over pressure or when desired by way of solenoid operated shut-off valves (55) and (56) respectively which when operated can bypass the pressure relief valves (28) and (29) to vent the respective outlets to the return (21). In the case of the high pressure circuit, the vented outlet from the shutoff valve (56) is further controlled by a pressure relief valve (57) adjustable for safety purposes to open at pressures just in excess of those required to move the operating platen whereby very little remaining force to damage items inadvertently left between the platens is available. It should be noted that a counter balance valve would be required for larger down acting designs. When not otherwise vented, a maximum operating pressure remotely adjustable pressure relief valve (58) is connected between the high-pressure output from pump (24) to vent that pressure to the return (21) should the maximum desired operating pressure to which this relief valve is set, be exceeded. Typically, relief valve (29) is set to a pressure beyond which damage to the press or its driving equipment might occur, while the pressure relief valve (58) is set to a maximum desired operating pressure for the system below that of the setting of the valve (29). Control of the shut-off valves and the adjustable pressure relief valves is by way of a programmed electronic controller (not shown).

The high pressure outlet from the pump (24) is fed to a four unit (valve controlled restrictor) valve group (60) and to double acting actuators (8) and (10) used to lock the top platen (3) or the lower platen (5) into a fixed position relative to the housing (7). Flow to these actuators (8) and (10) is by way of a pressure reducing valve (61) which reduces the high pressure for supply to the actuators (8) and (10) to 500 lbs/square in. The choice of which actuators ought to be supplied and which are to be exhausted to the return (21) is facilitated by a two-position solenoid operated spool valve (62) whereby only actuators (8) or actuators (10) can be activated at the same time to lock their respective platens into position.

The valve group (60) comprises four valves connected in parallel to receive high pressure fluid from the high pressure outlet of the pump (24) and operable individually or in combination to provide 15 different high pressure flow rates which are instantly available to drive the actuators of the active platen (3) or (5). The outlets from the valve group (60) pass through flow restrictors and a pilot operated non-return (check) valve (63) to a control valve (64) for control of the four actuators of (2A, 2B, 2C and 2D) by way of valves (38, 39, and 40) in similar manner and providing similar operating combinations to those described with reference to FIG. 4. It will be noted that valve (64) is similar to valve (20) with the exception of the provision of a bypass connected between the first and second ports when the valve is in its central position as shown in FIG. 8. This bypass permits the supplied high-pressure fluid flow to be vented to reservoir (22) when the valve is in this position. The low pressure output from the pump (23) is arranged to pass by way of a non-return (check) valve (36) to the supply line extending from the valve group 60) to the check valve (63). The pressure relief valve (28) and shut-off valve (55) are connected to the low pressure outlet of the pump (23) between that pump and the check valve (36).

An accumulator (65) containing hydraulic fluid under pressure is controlled by a solenoid operated two position spool valve (66) and a two position solenoid operation spool valve (67). In the position shown, valve (66) shuts off the accumulator from supplying the pilot operated check valve (63) while in the second position of this valve, upon operation of its solenoid, the fluid accumulated in the accumulator (65) is arranged to open the pilot operated check valve (63) to reverse flow in order that the system pressure may be relieved. Valve (67) in the position shown serves to permit high pressure supply fluid passing check valve (63) to charge the accumulator (65) by way of a check valve (68) which provides for the quick filling of the accumulator while forcing discharge of the accumulator to be through a flow restrictor (69). In the second position of valve (67), upon operation of its solenoid, the accumulator is cut off from a supply of charging fluid. The fluid supply passing through check valve (63) is measured by a pressure transducer (70). A shut-off valve (71) allows the accumulator to be vented to the return (21).

It should be noted that ports marked with an "X" in the valves of this FIG. 8 are plugged ports. Passing through the check valve (63) are the flows from the low pressure outlet of the pump (51) and the flow controlled by the valve group (60). The combined flow is one of three possible flows of the output of pump (23,24) when, for example, 12½% and 8½% respectively. These three possible flows are 12½%, 8½%, assuming that the available high pressure flow is all passed through the valve group (60) and 100% with the same assumption. However, the valve group (60) can control the 12½% flow to any one of 15 discrete magnitudes, depending upon the combination of valves of the groups (60) which are actuated, to provide a total of 31 different flow rates, namely, (a) 15 variations of the 12½% high pressure flow with the low pressure flow vented, (b) the 8½% flow rate from the low pressure outlet with the 12½% flow from the high pressure outlet fully vented and (c) the combination of the 8½% with the 15 variations of the remaining 12½% as controlled by the valve group (60). To this is added the three combinations of actuator (2A, 2B, 2C and 2D) operation to provide a total of 91 closing and opening speeds. In addition, when the press is closed, but at the point where no tonnage is being applied, there are 15 flow rates available by way of the valve group (60) to control the rate at which pressure is increased from 0–2,000 lbs/square in. in the system to build the desired tonnage, thereby to allow compression of an item being pressed slowly or rapidly in 15 repeatable steps. Once the desired tonnage and pressing operation is complete the motor (25) may be turned off reducing the drive energy to 0. The reverse flow of the hydraulic fluid is blocked by check valve (63) with any leakage loss being replaced by the accumulator as desired. The pressure transducer (17) provides a pressure signal which is evaluated by the programmable electronic control means (not shown) to determine the necessary valve-motor control functions.

By way of example, the following compares the operational characteristics pump/motor sizes for a conventional, single-cylinder, single-acting, hydraulic press with the four cylinder double-acting press of the present invention.

STANDARD HYDRAULIC PRESS

3 Speed Close/Open
Single Acting (ONLY ONE PLATEN MOVES)
Close Ton > Open Ton
3 Platen Construction
Compression Tonnage—200 T
Crack Tonnage—120 T
Pump and Motor:
  Hi/Lo System
  135 Gal./Min. Hi Vol. Pump
  15 Gal./Min. Lo Vol. Pump
  350 Gal. Tank
  23.6 H.P. Motor
Close Time—4.17 Sec.
Open Time—3.01 Sec.
Cost/Hour—$0.91@$0.06/KWH

HYDRAULIC PRESS OF PRESENT INVENTION (BASIC FORM)

9 Speed Close/Open
Double-Acting (EITHER PLATEN IS MOVABLE)
Close Ton TM Open Ton
2 Platen Construction
Compression Tonnage—200 T
Crack Tonnage—200 T
Pump and Motor:
  Hi/Lo System
  33.37 Gal./Min. Hi Vol. Pump
  4.12 Gal./Min. Lo Vol. Pump
  50 Gal. Tank
  3.8 H.P. Motor
Close Time—4.19 sec. minimum
Open Time—4.19 sec. minimum
Cost/Hour—$0.06@$0.06/KWH By way of comparison, it should also be noted that if the pump and motor characteristics of the standard hydraulic press are used in the press of the present invention, the opening and closing time is reduced to a minimum of 1.05 seconds.

Apart from the versatile operating characteristics which the present invention permits in a lightweight economical to produce construction, the present design has the advantages of providing a double-acting (that is up-acting with the top platen fixed and down-acting with the bottom platen fixed) operation with opening and closing tonnages which are equal in both actuating directions and with a substantial reduction in pump/motor requirements for the same tonnage and opening and closing time. If the same pump/motor arrangements are used as in the prior art press, the opening and closing times can be very substantially reduced.

The arrangement disclosed in FIGS. 1, 2 and 3 of the present application facilitates the complete removal of the press and its operating mechanisms from the housing (7) for the purposes of maintenance and greatly facilitates this maintenance.

It should be noted that while the invention has been described with respect to four actuators disposed in a symmetrical arrangement in two symmetrical pairs, a greater number of symmetrical pairs could be utilized. It should also be noted that the actuators utilized may not be in a totally symmetrical arrangement. It is only necessary for each pair of actuators to be symmetrically disposed about a working area of the platens and for all pairs of actuators to be so arranged, thus one actuator from each of two pairs of actuators could be disposed close to one another with the other actuators of those pairs being disposed symmetrically on the other side of a working area. Further, it is not necessary in view of the equal piston area on both sides of the double acting pistons of these actuators, for all housings of the actuators to be attached to one of the platens while all piston rods are attached to the other of the platens. Some housings could be attached to one platen, some to the other platen with their respective piston rods attached to the opposite platen. Of course, the arrangement shown if FIG. 1 could be reversed and all of the housings could be attached to the upper platen (3) while the associated piston rods are attached to the lower platen (5). In addition, valves (38) and (39) could be replaced by a single two position valve having the functions of either valve (38) or (39) and connected to control both actuators (2A and 2C) for parallel operation.

As a final alternative, it will be appreciated that pilot operated valves might be used in place of the solenoid operated control valves referred to above.

Other variations falling within the scope of the present invention will be apparent to those skilled in the art.

I claim:

1. A hydraulic press comprising:

a pair of platens defining a work area therebetween;

a plurality of pairs of like double-acting hydraulic actuators, each actuator interconnecting the platens to provide an actuating force to change the spacing between the platens, each said pair of actuators being disposed symmetrically about said work area whereby upon actuation of at least a said pair of actuators in unison a force is created acting along an axis passing through said work area with all said pairs of actuators, when acting in unison, producing an actuating force along the same said axis, and a control means associated with said hydraulic press and interconnecting said pairs of actuators with hydraulic fluid for controlling a supply of the hydraulic fluid under pressure to the actuators so that, in a first operating mode, a said first pair of said actuators function in series to provide a first rate of change of said spacing, in a second mode, at least said first pair of actuators function in parallel to provide a second rate of change of said spacing which is less than the rate of change of the first mode and, in a third mode, at least said first pair of actuators function in accordance with said second mode while simultaneously a second pair of said actuators function in parallel with said first pair of actuators thereby to provide a maximum actuating force of which first and second pairs of said actuators together are capable for that fluid supply.

2. A hydraulic press according to claim 1, wherein said second pair of actuators are passive when the first pair of actuators are operated in the first mode and while the first pair of actuators are operated in the second mode.

3. A hydraulic press according to claim 1 comprising two said pairs of actuators consisting of four actuators disposed symmetrically about said work area.

4. A hydraulic press according to claim 1 wherein each actuator comprises a housing defining a cylinder and a piston rod assembly movable relative to said housing by said supply of hydraulic fluid, each said actuator being double-acting and capable of generating the same actuation force in each of its two directions of actuation, said housing being rigidly attached to one said platen while the piston rod assembly is rigidly attached to the other said platen wherein said actuators not only provide the means for changing the spacing between said platens, but also the guidance of the platens relative to one another.

5. A hydraulic press according to claim 1, comprising support means for said press actuable to fix one of said platens relative to a support structure while allowing the other said platens to be moved to change the spacing between said platens upon actuation of said actuators and vice versa.

6. A hydraulic press according to claim 5, wherein said support means may be actuated to release the press for removal from the support structure to facilitate maintenance.

7. A hydraulic press according to claim 6, wherein said press support structure supports said platens and actuators together with control means and a hydraulic motor and pump means associated with said hydraulic supply for removal as a unit for maintenance.

8. A hydraulic press according to claim 1, further comprising a motor driven pump means to provide said fluid supply.

9. A hydraulic press according to claim 8, wherein said pump means comprises a relatively high pressure relatively low flow rate fluid supply pump and a relatively low pressure relatively high flow rate fluid supply pump and said control means is arranged to supply said actuators with the fluid supply from one of one, the other and both of said pumps as desired.

10. A hydraulic press according to claim 1, wherein said control means comprises a three position spool primary valve to control the supply of fluid to the actuators, said primary valve's three positions comprising a cross-flow position, a closed flow position and a parallel flow position, said cross-flow position being used to actuate said actuators in one of their double-acting directions, said closed flow position being used to prevent the supply of fluid from said fluid supply to said actuators and said parallel flow position being arranged to supply said fluid to said actuators for operation in the other of their double-acting directions.

11. A hydraulic press according to claim 10, wherein a two position spool valve interconnects said first pair of actuators and, in a first position, said spool valve causes fluid flow through said first pair of actuators in series when said fluid flow is supplied by said three position spool primary valve and, in a second of said positions, causing fluid flow through said first pair of actuators in parallel when said fluid flow is supplied by said three position spool primary valve.

12. A hydraulic press according to claim 11, wherein each of said second pair of actuators is controlled by at least one two position spool valve, the two positions of each spool valve being a cross-over position and a bypass position, said cross-over being used in dependence upon whether at least one of full tonnage and less speed is required for said second pair of actuators and the bypass position being used when said actuators are to be passive with supply ports thereof interconnected through said further valves.

13. A hydraulic press according to claim 12, further comprising pump means having a relatively high pressure relatively low fluid supply rate pump which is controlled by a plurality of valves disposed in parallel to provide binary control of flow in dependence on the number of these valves open for passage therethrough of the relatively high pressure relatively low flow fluid to said primary valve.

14. A hydraulic press according to claim 13, comprising four restrictor flow control valves providing fifteen discrete flow rates dependent upon the number and choice of such valves.

15. A hydraulic press according to claim 12, further comprising pump means having a relatively high pressure relatively low flow rate fluid supply pump and a relatively low pressure relatively high flow rate fluid supply pump and said control means is arranged to supply said actuators with the fluid supply from one of one, the other and both of said pumps as desired, wherein said relatively high pressure relatively low flow fluid supply pump is controlled by a plurality of valves disposed in parallel to provide binary control of flow in dependence on the number of these valves open for passage therethrough of said relatively high pressure relatively low rate fluid supply to said primary valve.

16. A hydraulic press according to claim 15, comprising four restrictor flow control valves providing fifteen discrete flow rates dependent upon the number and choice of such valves.

17. A hydraulic press characterized by:

a pair of platens defining a work area therebetween;

a plurality of sets of like double-acting hydraulic actuators each actuator interconnecting the platens at least when a maximum actuating force to change the spacing between the platens is required, each said set of actuators being disposed symmetrically about said work area thereby upon actuation of at least a said set of actuators in unison a force is created acting along an axis passing through said work area with all said sets of actuators, when acting in unison, producing an actuating force along the same said axis, and a control means associated with said hydraulic press and interconnecting said sets of actuators with hydraulic fluid for controlling a supply of the hydraulic fluid under pressure to the actuators so that, in a first operating mode, at least one of said first set of said actuators functions to provide a first rate of change of said spacing, and, in a further operating mode, at least said first set of actuators function in parallel to provide a rate of change of said spacing which is less than the first rate of change while simultaneously a second set of said actuators functions in parallel with said first set of actuators thereby to provide a maximum actuating force of which the first and second sets of said actuators together are capable for that fluid supply.

18. A hydraulic press according to claim 17, characterized in that said sets are each pairs and said control means associated with said hydraulic press and interconnecting said pairs of actuators with hydraulic fluid controls said supply of the hydraulic fluid under pressure to the actuators so that, in said first operating mode, said first pair of said actuators function in series to provide said first rate of change of said spacing, in a second mode, at least said first pair of actuators function in parallel to provide a second rate of change of said spacing which is less than the rate of change of the first mode and, in said further, third, mode, at least said first pair of actuators function in accordance with said second mode while simultaneously a second pair of said actuators functions in parallel with said first pair of actuators thereby to provide a maximum actuating force of which the first and second pairs of said actuators together are capable for that fluid supply.

* * * * *